United States Patent [19]

Warrington

[11] Patent Number: 4,849,742

[45] Date of Patent: Jul. 18, 1989

[54] TOILET SEAT COVER POSITION ALARM

[76] Inventor: Blake Warrington, 7624 Arbor Creek Cir., Dublin, Calif. 94568

[21] Appl. No.: 274,476

[22] Filed: Nov. 21, 1988

[51] Int. Cl.[4] ..... G08B 21/00

[52] U.S. Cl. ..... 340/686; 4/661; 340/623

[58] Field of Search ..... 340/686, 612, 618, 623–625, 340/545–546; 200/61.62; 4/661

[56] References Cited

U.S. PATENT DOCUMENTS

| | | | |
|---|---|---|---|
| 4,413,364 | 11/1983 | Bittaker et al. | 4/661 |
| 4,447,933 | 10/1984 | Leckle | 4/253 |
| 4,491,991 | 1/1985 | Herbruck | 4/661 |
| 4,521,919 | 6/1985 | Molloy | 455/344 |
| 4,547,768 | 10/1985 | Kulhavy | 340/620 |
| 4,733,419 | 3/1988 | Nee | 4/661 |
| 4,736,471 | 4/1988 | Johnson | 4/661 X |

*Primary Examiner*—Glen R. Swann, III

*Assistant Examiner*—Thomas J. Mullen, Jr.

*Attorney, Agent, or Firm*—Harris Zimmerman; Howard Cohen

[57] ABSTRACT

A signaling device is actuated for a limited period of time if a toilet seat cover is not promptly lowered following flushing of the toilet. In the preferred form, an electrically operated signaling device is coupled to an electrical power source through a magnetically actuated switch at the front of the toilet tank and also through a second switch. A magnet fastened to the seat cover closes the magnetically actuated switch when the cover is in the raised position and movement of a float in the toilet tank in response to flushing closes the second switch for a limited period following initiation of flushing. The device reminds users of the toilet to close the cover. This avoids discomfort to a subsequent user of the toilet and assures that small children and pets are blocked from the toilet bowl.

12 Claims, 1 Drawing Sheet

TOILET SEAT COVER POSITION ALARM

TECHNICAL FIELD

This invention relates to accessory equipment for toilets and more particularly to alarms for indicating that a toilet seat cover is in the raised or open position.

BACKGROUND OF THE INVENTION

Toilets are generally equipped with a hinged seat and a hinged cover or lid both of which should be lowered to the closed position following use of the toilet. An open toilet bowl does not present a particularly attractive appearance and creates other problems as well. Small children and household pets can be attracted to an open toilet and may attempt to enter the bowl. This is obviously undesirable from the standpoint of sanitation and can also be hazardous if the attempt is successful.

If both the cover and toilet seat are left in the raised position, the condition can be highly discomforting to a subsequent user who fails to notice the situation.

Toilet bowl covers and sometimes the seat as well are often left in the open condition through carelessness or inadvetence.

Efforts have heretofore been made to provide alarms which generate an audible or visible signal when a toilet bowl cover is in the open position. As heretofore constructed such alarms are subject to problems that create inconvenience or discomfort to users of the toilet and which discourage the use of such alarms.

Activation of an alarm while the toilet is occupied can be distracting and embarassing to the person using the toilet. One prior solution to this problem provides a pressure sensitive switch attached to the underside of the cover which inactivates the alarm as long as the back of a person using the toilet bears against the cover. This is not a fully reliable solution to the problem as persons using the toilet do not necessarily exert pressure on the cover or may do so only intermittently.

A seat cover position alarm should preferably not be activated immediately after usage of the toilet as the person may proceed to lower the seat and cover. The above described prior construction addresses this problem by including a timer which delays the alarm for a fixed period after the pressure sensitive switch senses that no pressure is being exerted on the raised seat cover. This is also not fully reliable since as pointed out above, users of the toilet may not exert pressure on the cover. Also, expiration of a fixed time period does not necessarily means that the person will not close the seat and cover before departing.

It is also preferable under many circumstances that the alarm sound only for a limited period if the seat cover is left up.

The present invention is directed to overcoming one or more of the problems discussed above.

SUMMARY OF THE INVENTION

In one aspect, the present invention provides an alarm for producing a signal when the seat cover of a toilet is left in the open position, the toilet being of the type having a bowl, a water tank and flushing means for selectively releasing water from the tank into the bowl and the alarm having signaling means and cover position sensing means for actuating the signaling means in response to an open condition of the cover. The device further includes means for sensing flushing of the toilet and disabling means for disabling the signaling means except during a limited time period that follows flushing of the toilet.

In another aspect, the invention provides an alarm for generating a signal if the seat of a toilet remains up following use of the toilet and which includes an electrically actuated signal generator, an electrical power source and means for defining an electrically conductive path between the signal generator and power source to enable actuation of the signal generator. First sensing means block current flow along the conductive path when the seat cover is in the lowered closed condition. Second sensing means block current flow along the path when the water level in the toilet tank is above a predetermined elevation. Thus the signal generator is actuated for only a limited time period following flushing of the toilet and only if the seat cover is up at that time.

In still another aspect, the invention provides an alarm for producing a signal if the seat cover of a toilet is left in the open position which includes an electrically actuated signaling device, means for attaching the signaling device to the toilet, a battery and first and second electrical switches connected between the battery and signaling device to jointly establish a conductive path between the two when both switches are in the closed condition. A seat cover position sensor has means for closing the first switch when the seat cover is in the raised position and a water level position sensor has means for closing the second switch when the water level in the toilet tank is below a predetermined level.

The invention senses flushing of a toilet as well as the position of the seat cover and generates an audible signal or other form of signal if the cover remains raised after initiation of flushing of the toilet. In the preferred form the device responds to the lowering of the water level in the toilet tank following flushing and the subsequent rise of the water level to provide a signal which does not begin immediately upon flushing and which does not continue indefinitely if the cover is intentionally left up. Thus the alarm does not issue signals during actual use of the toilet regardless of the position or actions of the user of the toilet nor afterwards provided that the seat cover is promptly closed. The alarm has the practical effect of conditioning persons who use the toilet to routinely close toilet seat cover.

DETAILED DESCRIPTION OF THE PREFERRED EMBODIMENT

Figure 1:
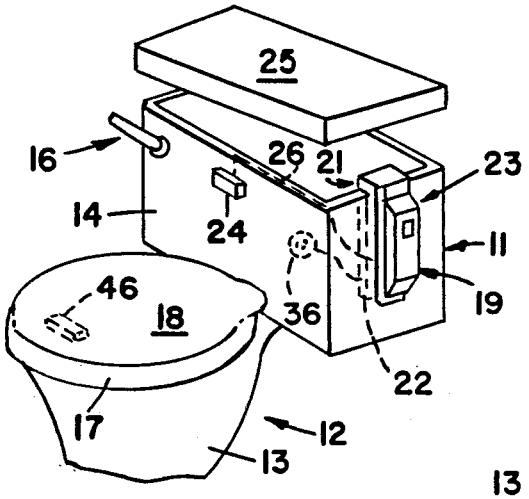
FIG. 1 is a perspective view of a toilet equipped with an alarm device in accordance with the preferred embodiment of the present invention.

Referring initially to FIG. 1 of the drawings, a toilet seat cover position alarm 11 in accordance with this embodiment of the invention is designed to be emplaced on a toilet 12 of the common type which has a bowl 13, a water tank 14, and flushing means 16 for releasing a volume of water from the tank to flush matter from the bowl. Such toilets 12 are customarily equipped with a hinged toilet seat 17 which is usually left down by females during use of the toilet but which may be left up by males. In the common toilet construction, the seat 17 is overlain by a hinged lid or cover 18 which is intended to be lowered after usage of the toilet to cover the bowl. However, as a practical matter the cover 18 and sometimes the seat 17 as well are often left up.

Following flushing, the alarm 11 alerts a user of the toilet 12 if the cover 18 has not been promptly lowered. Lowering of the cover 18 necessarily requires that the seat 17 also be lowered and thus the alarm 11 in effect also serves the purpose of reminding the toilet user to lower the seat if it should be up.

For the foregoing purpose, the alarm 11 includes a first component housing 19 with means 21 for attaching the housing to to toilet 12. In the present example, such means 21 is a hook-like bracket 22 shaped to be fitted onto the rim of a sidewall 23 of the toilet 12 although other attachment means may also be used. A smaller switch housing 24 is connected to housing 19 by a flexible insulated two conductor electrical cord 26.

Figure 2:
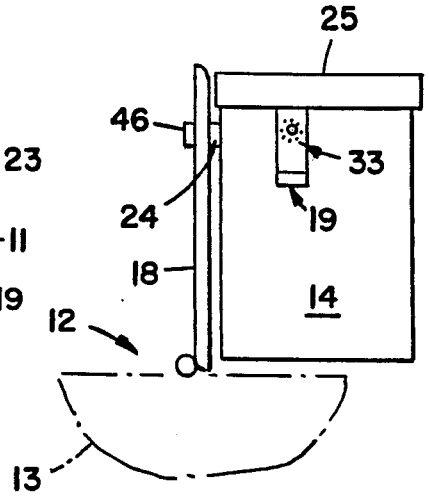
FIG. 2 is a side elevation view of the toilet of FIG. 1 further illustrating the emplacement of the present invention thereon.

Referring to FIGS. 1 and 2 in combination, cord 26 is of sufficient length to enable the switch housing 24 to be attached to the front central region of the water tank 14 preferably just under the removable lid 25 of the tank although other placements are also possible. The switch housing 24 may be secured to the tank 14 by adhesive, for example.

Figure 3:
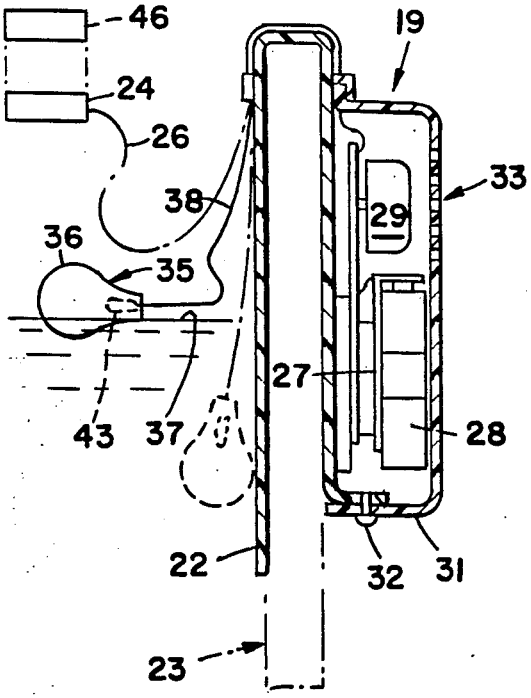
FIG. 3 is a partially diagramatic cross section view of of the alarm of the preceding figures emplaced on a toilet.

Referring now to FIG. 3, the component housing 19 contains an electrical battery support 27, for receiving a battery 28, and an electrically actuated signaling device 29. The signaling device 29 is a buzzer or beeper in this embodiment of the invention although other signaling means such as warning lamps which emit a visual signal may also be used in place of the audible signaling device 29 or in conjunction with the device 29.

Component housing 19 has a removable cover 31, normally held in place by a screw 32, to enable replacement of of battery 28. Cover 31 is transpierced by an array of apertures 33 preferably located adjacent the audible signaling device 29. Apetures 33 form an acoustical window for transmitting sound out of the housing 19.

The alarm 11 includes flush sensing means 34 for detecting flushing of the toilet which means in this embodiment includes a buoyant float 36 that floats on the water 37 within the toilet tank when the water level is at or near the maximum level. Float 36 has an elongated configuration including a relatively narrow neck region 35 which causes the float to float on its side with the neck region extending more or less horizontally. Another two conductor electrical cord 38 extends from the neck 35 of the float 36 to component housing 19.

The length of cord 38 is selected to enable float 36 to float on its side in the manner described above when the tank 14 is full or nearly full but the cord is sufficiently short to prevent the float from dropping as far as the water level drops during flushing of the toilet. Consequently, the float 36 is pulled into a more or less vertical orientation with neck 35 uppermost, as shown in dashed lines in FIG. 3, when the water level 37 has dropped a distance during the initial stage of the flushing cycle. The float remains in that vertical orientation until the water level 37 again approaches its highest elevation during the final stage of the flushing cycle.

Figure 4:
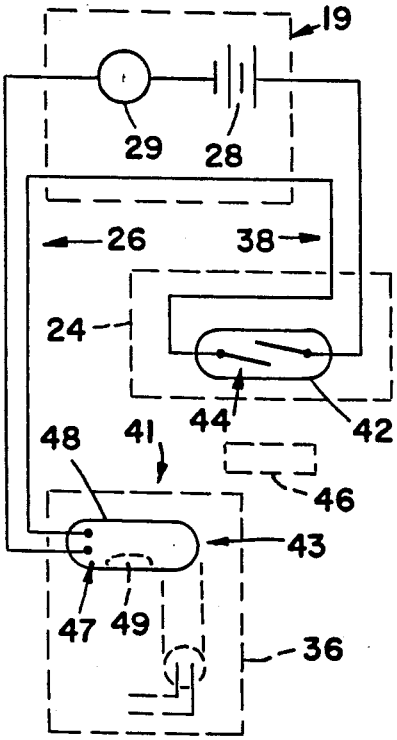
FIG. 4 is an electrical circuit diagram of a suitable internal electrical circuit for the apparatus of the preceding figures.

Referring now to FIG. 4, the switch housing 24 contains cover position sensing means 42 and float 36 contains disabling means 43 for disabling the signaling means 29 except during a limited time period that follows actuation of the toilet flushing mechanism. Such means 42 and 43 in this embodiment of the invention each have a normally open electrical switch, 42 and 43 respectively, which switches are connected in series relationship with each other and with the battery 28 and signaling device 29 through the electrical cords 26 and 38.

Cover position sensing switch 42 is of the magnetic type having a reed like spring contacts 44 which are resiliently biased towards the open position of the switch but which deflect to close the switch when a magnet 46 is brought into proximity with the switch. With reference to FIGS. 1 and 4 in conjunction, the magnet 46 is fastened to the toilet seat cover 18 at a location on the cover which causes the magnet to be brought into proximity with switch housing 24 when the cover is pivoted to the raised or open position.

Toilet seat covers 18 are usually formed of non-magnetic materials which are penetrable by a magnetic field. Under such conditions, the magnet 46 is preferably attached to the underside of cover 18 with adhesive or by other means. If the thickness of the cover is too great to allow the magnet to operate switch contacts 44, the magnet 46 may be fastened to the top surface of the cover 18 . The latter arrangement is also in order if the cover 18 is formed of steel or other magnetic material.

Referring jointly to FIGS. 3 and 4 the switch 43 of the signal disabling means 41 in this embodiment of the invention is a normally open mercury switch of the type having spaced apart contacts 47 at one end of an elongate capsule 48 that contains a globule of mercury 49. Such switches are in the open condition when the capsule 48 is in a horizontal orientation and close when the capsule is turned to a vertical position causing the mercury 49 to bridge the contacts 47. The mercury switch 43 is secured within float 36 with the capsule 48 being in alignment with the neck 35 of the float. Thus the switch 43 is open while the float 36 is floating on water 37 but closes to conduct current when the float is shifted to the vertical orientation during flushing of the toilet as previously described.

In operation, with reference again to FIGS. 1 and 4 in conjunction, flushing of the toilet 12 results in a temporary lowering of the water level in tank 14. This lowers float 36 and when the slack in cord 38 has been taken up the float becomes suspended by the cord and is shifted into the vertical orientation which closes the mercury switch 43, if not already closed due to the movement of the float. This results in actuation of the signaling device 29 if switch 42 is also closed at that time by the field of magnet 46 as a result of the cover 18 being in the open position. The alarm 11 is not activated if the cover 18 is down as magnet 46 is too distant from switch 42 to cause closing of the switch.

It is preferable to provide for some slack in cord 38 when the float 36 is at its uppermost level as this delays actuation of signaling device 29 for a brief interval immediately following actuation of the flushing mechanism 16. This avoids an unnecessary activation of the alarm 11 if the user of the toilet 12 proceeds promptly to close the cover 18.

The signaling device 29 is deactuated after a period of time, regardless of the position of the cover 18, as the rising water 37 during refilling of tank 14 again buoys up the float 36 causing it to resume the horizontal orientation which opens the mercury switch 43. This opens the circuit between battery 28 and the signaling device 29.

While the invention has been described with respect to a single preferred embodiment, many modifications and variations in the construction of the alarm 11 are possible and it is not intended to limit the invention except as defined in the following claims.

I claim:

1. In an alarm for producing a signal when the seat cover of a toilet is left in the open position, said toilet having a bowl, a water tank and flushing means for selectively releasing water from the tank into the bowl, said alarm having signaling means and cover position sensing means for actuating said signaling means in response to an open condition of said cover, the improvement comprising:

flush sensing means for detecting flushing of said toilet, and disabling means for disabling said signaling means except during a limited time period that follows initiation of flushing of said toilet.

2. The alarm of claim 1 wherein said disabling means delays actuation of said signaling means for an interval immediately following initiation of flushing of said toilet.

3. The alarm of claim 1 wherein said flush sensing means inactivates said disabling means in response to lowering of the water level in said tank to a predetermined elevation and reactivates said disabling means upon rising of the water level in said tank.

4. The alarm of claim 1 wherein said signaling means is an electrically actuated device, further including a source of electrical current, and wherein said cover position sensing means includes a first electrical switch coupled between said current source and said signaling device for establishing one portion of a conductive path therebetween when said toilet seat cover is in said open condition, wherein said disabling means includes a normally open second electrical switch forming another portion of said conductive path, and wherein said flush sensing means closes said second switch for said limited time period in response to flushing of said toilet.

5. The alarm of claim 4 wherein flush sensing means includes a float for disposition within said water tank, and means for causing lowering of said float to close said second electrical switch and rising of said float to open said second switch.

6. The alarm of claim 5 wherein said second electrical switch is a mercury switch contained within said float and is of the type which is open when in a first orientation and which closes when turned to a second orientation, further including an electrical cord fastened to said float and means for suspending said float by said cord at an intermediate level in said tank when the water therein drops during flushing of said toilet, said cord being attached to said float at a location offset from the center thereof to cause said second switch to have said first orientation when said float is floating on said water and to shift to said second orientation when said float is suspended by said cord.

7. The alarm of claim 4 wherein said flush sensing means closes said second switch only after the water level in said tank has been dropping for a period of time greater than that required for closing of said toilet seat cover.

8. The alarm of claim 4 wherein said first electrical switch is a normally open magnetically operated switch attached to said water tank and wherein said cover position sensing means further includes a magnet for attachment to said toilet seat cover at a location thereon where said magnet causes closure of said first switch when said cover is in the opened position.

9. An alarm for generating a signal if the seat cover of a toilet remains up following use of the toilet, comprising an electrically actuated signal generator, an electrical power source, means for defining an electrical conductive path between said signal generator and said electrical power source to enable actuation of said signal generator, first sensing means for blocking current flow along said conductive path when said seat cover is in the lowered closed position thereof, and second sensing means for blocking current flow along said path when the water level in the water tank of said toilet is above a predetermined elevation therein whereby said signal generator is actuated for only a limited time period in response to flushing of said toilet and is only actuated at that time if said seat cover is up.

10. An alarm for producing a signal if the seat cover of a toilet is left in the open position, said toilet having a bowl, a water tank and flushing means for releasing water from said tank into said bowl, comprising:

an electrically actuated signaling device, means for attaching saidi signaling device to said toilet, an electrical battery, first and second electrical switches connected between said battery and said signaling device to jointly establish a conductive path therebetween when both switches are in the closed condition, a seat cover position sensor having means for closing said first switch when said seat cover is in the raised position, and a water level position sensor having means for closing said second switch when the water level in said toilet tank is below a predetermined level.

11. The alarm of claim 10 wherein said first switch is a normally open magnetically operated switch having means for attachment to the front wall of said water tank in position to be closed by a magnet attached to said toilet seat cover when said cover is raised to the open position.

12. The alarm of claim 10 wherein said water level position sensor includes a float for disposition in said water tank and wherein said second switch is secured to said float and is of the form which is open when in a first orientation and which closes when turned to a second orientation, further including means for shifting the orientation of said float and second switch to close said second switch during periods when the water level in said tank is below a predetermined elevation.

* * * * *